US008622648B2

(12) United States Patent
Mustafa

(10) Patent No.: US 8,622,648 B2
(45) Date of Patent: Jan. 7, 2014

(54) CUSHIONED COVER FOR TRAFFIC STRUCTURES

(76) Inventor: Ibtesam M. Y. Mustafa, Kuwait (KW)

( * ) Notice: Subject to any disclaimer, the term of this patent is extended or adjusted under 35 U.S.C. 154(b) by 0 days.

(21) Appl. No.: 13/283,102

(22) Filed: Oct. 27, 2011

(65) Prior Publication Data

US 2013/0108361 A1 May 2, 2013

(51) Int. Cl.
*E01F 13/00* (2006.01)

(52) U.S. Cl.
USPC ..... 404/6

(58) Field of Classification Search
USPC ..... 404/6; 5/663; 248/345.1
See application file for complete search history.

(56) References Cited

U.S. PATENT DOCUMENTS

| | | | | |
|---|---|---|---|---|
| 3,831,941 | A * | 8/1974 | Pease | 267/116 |
| 4,244,156 | A * | 1/1981 | Watts, Jr. | 52/746.1 |
| 4,541,136 | A * | 9/1985 | Graebe | 5/655.3 |
| 4,674,911 | A | 6/1987 | Gertz | |
| 5,314,261 | A | 5/1994 | Stephens | |
| 5,360,286 | A | 11/1994 | Russell | |
| 5,575,966 | A | 11/1996 | Baatz | |
| 5,613,798 | A * | 3/1997 | Braverman | 404/6 |
| 5,869,159 | A * | 2/1999 | Padilla | 428/40.1 |
| 5,894,616 | A * | 4/1999 | Graham et al. | 5/424 |
| 6,010,275 | A | 1/2000 | Fitch | |
| 6,242,070 | B1 * | 6/2001 | Gillispie et al. | 428/99 |
| 6,269,505 | B1 * | 8/2001 | Wilkinson | 5/713 |
| 6,413,009 | B1 | 7/2002 | Duckett | |
| 6,551,011 | B1 * | 4/2003 | Valentine | 404/6 |
| 6,932,537 | B2 | 8/2005 | Witcher | |
| 7,059,590 | B2 | 6/2006 | Bronstad | |
| 7,257,875 | B2 * | 8/2007 | Masinelli et al. | 29/449 |
| 7,617,792 | B1 * | 11/2009 | Pursley | 114/219 |
| 2004/0197140 | A1 * | 10/2004 | Maleska | 404/6 |
| 2004/0262588 | A1 | 12/2004 | Bronstad | |
| 2005/0152743 | A1 | 7/2005 | Kasraie | |
| 2008/0219762 | A1 * | 9/2008 | Maybee | 404/6 |
| 2011/0041250 | A1 * | 2/2011 | Satou et al. | 5/654 |

FOREIGN PATENT DOCUMENTS

| | | |
|---|---|---|
| CN | 201330985 | 10/2009 |
| GB | 1368772 | 10/1974 |
| JP | 9-100517 | 4/1997 |

OTHER PUBLICATIONS

Website, ftp://ftp.dot.state.pa.us/public/bureaus/design/SEMP/FACTS/Absorptive%20Sound%20Barrier%20Wall.pdf, sound-absorptive precast noise barrier wall, one sheet printed from the internet on Mar. 14, 2011.

* cited by examiner

*Primary Examiner* — Thomas B Will
*Assistant Examiner* — Abigail A Risic
(74) *Attorney, Agent, or Firm* — Richard C. Litman

(57) ABSTRACT

The cushioned cover for traffic structures comprises various embodiments configured for installation over concrete traffic barriers (e.g., "Jersey walls," etc.) or about vertical columns, posts, stanchions, etc., e.g., bridge support columns. The cover includes inner and outer layers formed of rubber, preferably using recycled tire material. A medial layer includes additional resilience. In one embodiment, the medial layer includes a plurality of closely spaced hemispherical elements, preferably formed of highly resilient polybutadiene material. In another embodiment, the center layer includes a plurality of closely spaced, pneumatically interconnected inflatable hemispheres. The traffic barrier covers may include planter box receptacles set into their upper surfaces when installed, and/or solar cells set into their upper surfaces to charge a storage battery for powering lighting set into the sides of the cover. Tread patterns may be provided in the outer surfaces of the traffic barrier covers.

9 Claims, 7 Drawing Sheets

CUSHIONED COVER FOR TRAFFIC STRUCTURES

BACKGROUND OF THE INVENTION

1. Field of the Invention

The present invention relates generally to protective covers, and particularly to a cushioned cover for traffic structures that provides an elastomeric or pneumatically cushioned cover for traffic structures, such as concrete barriers, stanchions, and the like.

2. Description of the Related Art

A number of different configurations of traffic structures have been developed over the years, including metal guardrails, cables either with or without chain link fencing installed therewith, and various other structures. Two very common types of traffic structures are the massive concrete traffic barriers (often called "Jersey walls" or "Jersey barriers") and vertical columns, posts, stanchions, and the like used to support overpasses and highway signs and lights. These two types of traffic structures comprise perhaps the majority of traffic structures, particularly in urban areas, and are nearly universally formed of hard, rigid materials that do not flex or yield significantly when they receive a significant impact force, as when struck by a vehicle.

While some thought and effort has gone into the design of "Jersey wall" type barriers in efforts to minimize the severity of vehicle accidents after contacting such barriers, the barriers generally do not serve particularly well in this regard. Most such barriers have outwardly sloped bases intended to cause the tire of a vehicle to ride slightly up the base upon impact and to turn the vehicle back into the traffic lane(s). While this serves to prevent the vehicle from crossing the barrier and impacting stationary objects to the side of the road or perhaps entering traffic flowing in the opposite direction, it does nothing to prevent perhaps extensive damage to the vehicle. Moreover, the deflection of the vehicle back into the traffic lane(s) often leads to multiple vehicle crashes as the deflected vehicle veers out of control back into perhaps heavy traffic.

Other traffic structures such as support columns, stanchions, posts, and the like, generally have little or no capability to reduce damage to either the traffic structure or to the vehicle upon impact. In fact, the solid, rigid materials of which these various traffic structures are made generally result in significant damage to a vehicle striking the structure. The structure itself generally fares no better, and generally requires replacement after a major impact. This often holds true even for massive concrete traffic barriers after a major impact, as well as for columns, stanchions and the like.

Some effort has gone into the development of traffic barriers and other traffic structures, as noted further above. One example of such effort is found in Japanese Patent Publication No. 9-100,517, published on Apr. 15, 1997. This reference describes (according to the drawings and English abstract) a decorative overlay for a guardrail. The overlay comprises a rubber baseboard, a transparent barrier layer, a "drawing sheet" of artwork or the like, and another transparent protective layer for the "drawing sheet".

None of the above inventions and patents, taken either singly or in combination, is seen to describe the instant invention as claimed. Thus, a cushioned cover for traffic structures solving the aforementioned problems is desired.

SUMMARY OF THE INVENTION

The cushioned cover for traffic structures is a cover that incorporates a plurality of resilient layers. In one embodiment, an innermost layer or ply of natural or synthetic rubber has a plurality of closely spaced, generally hemispherical (or other suitable shape) elements extending outwardly therefrom, and an outer layer or ply of natural or synthetic rubber overlaying the hemispherical elements. The hemispherical elements are preferably formed of a highly resilient polybutadiene elastomer used to manufacture a toy ball known as a "bouncy ball." The inner and outer layers are preferably formed of recycled tires for economy of manufacture and to reduce environmental impact.

A second embodiment includes the inner and outer rubber layers of the first embodiment, but employs a medial layer having a plurality of closely spaced, pneumatically interconnected inflatable hemispheres (or other suitable shape). The inflatable elements may be inflated to any suitable pressure as desired by means of a suitable conventional air pump.

Either of the above embodiments may be configured for installation to one or both sides of a concrete traffic barrier, a/k/a a "Jersey wall," or the like, or may be configured to wrap around a vertical column, stanchion, post, or the like, as in a bridge support column, traffic light, sign, or signal, etc. The thickness of the multiple rubber layers, particularly when continued over the top of a traffic barrier from one side of the barrier to the other, enables the material to be cut out and a planter box receptacle or the like to be formed therein. Alternatively, solar panels may be set into the upper surface to charge a conventional storage battery, which may then be used to power lighting set in the side(s) of the cover. A tread pattern may be formed in the outer surface of the outer layer of material when the cover is configured for installation over a concrete traffic barrier. Various means may be used to attach the cover to different traffic structures, depending upon the configuration of the traffic structures.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The cushioned cover for traffic structures is a flexible, resilient cover having multiple layers or plies of material. An intermediate layer may have various configurations to provide suitable resilience, and the cover may be configured to attach to or fit over or around various different traffic structures, such as concrete "Jersey walls," bridge support columns, stanchions, and other traffic structures.

Figure 1:
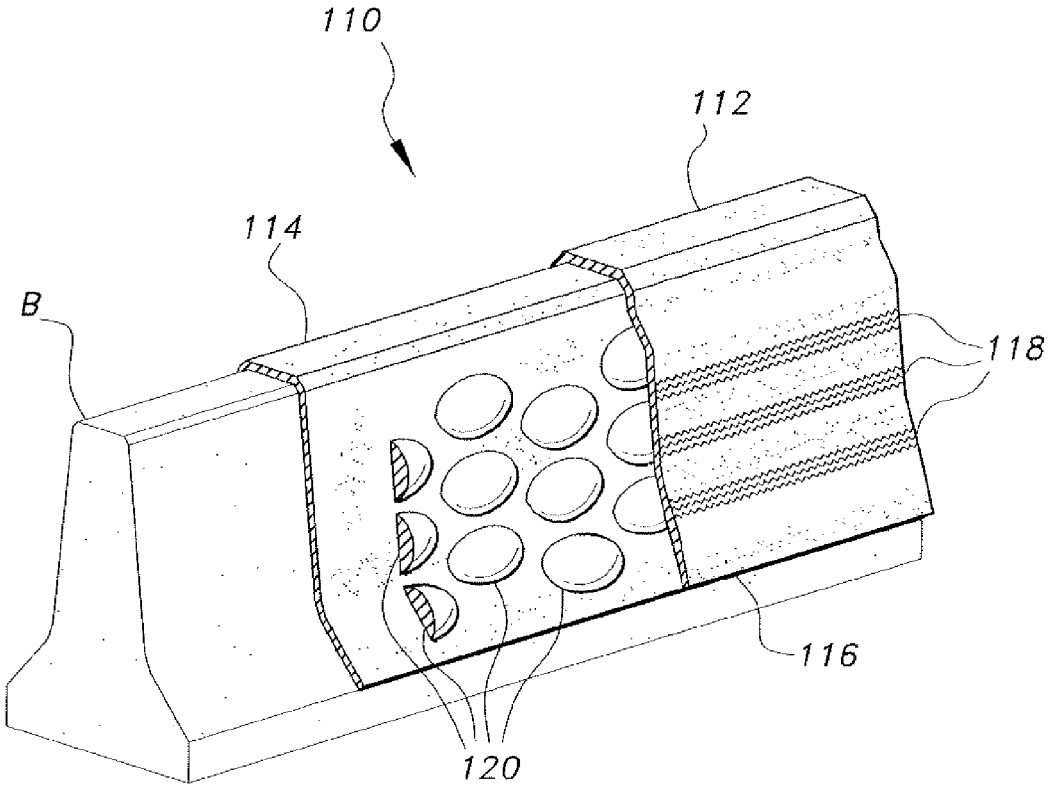
FIG. 1 is an environmental perspective view of a first embodiment of a cushioned cover for traffic structures according to the present invention, broken away and partially in section to show details thereof.

FIG. 1 of the drawings provides an environmental perspective view of a first embodiment 110 of a cushioned cover for traffic structures, shown installed upon a concrete traffic barrier or "Jersey wall" B, the cover 110 being shown partially broken away in order to show its internal structure. The cover 110 includes a continuous and unbroken outer layer 112 and a continuous and unbroken inner layer 114, the two layers 112 and 114 being preferably formed of a resilient elastomer material, such as natural or synthetic rubber, or a combination of the two. A rubber or elastomer with a relatively high durometer is suitable to provide good durability for the cover 110. Such materials as recycled vehicle tires are suitable for the manufacture of the two layers 112 and 114 of the cover 10, as the use of such recycled materials provides greater economy of manufacture and is also more environmentally beneficial. The two layers 112 and 114 are preferably molded or otherwise formed to conform to the general shape of the Jersey barrier B or other structure to which the cover 110 is to be applied. The two layers 112 and 114 are preferably bonded or otherwise joined to one another along their mutual edges 116. The outer layer 112 may include some form of tread pattern 118 disposed thereon in any pattern as desired, with an exemplary tread pattern 118 being shown in FIG. 1.

Figure 2:
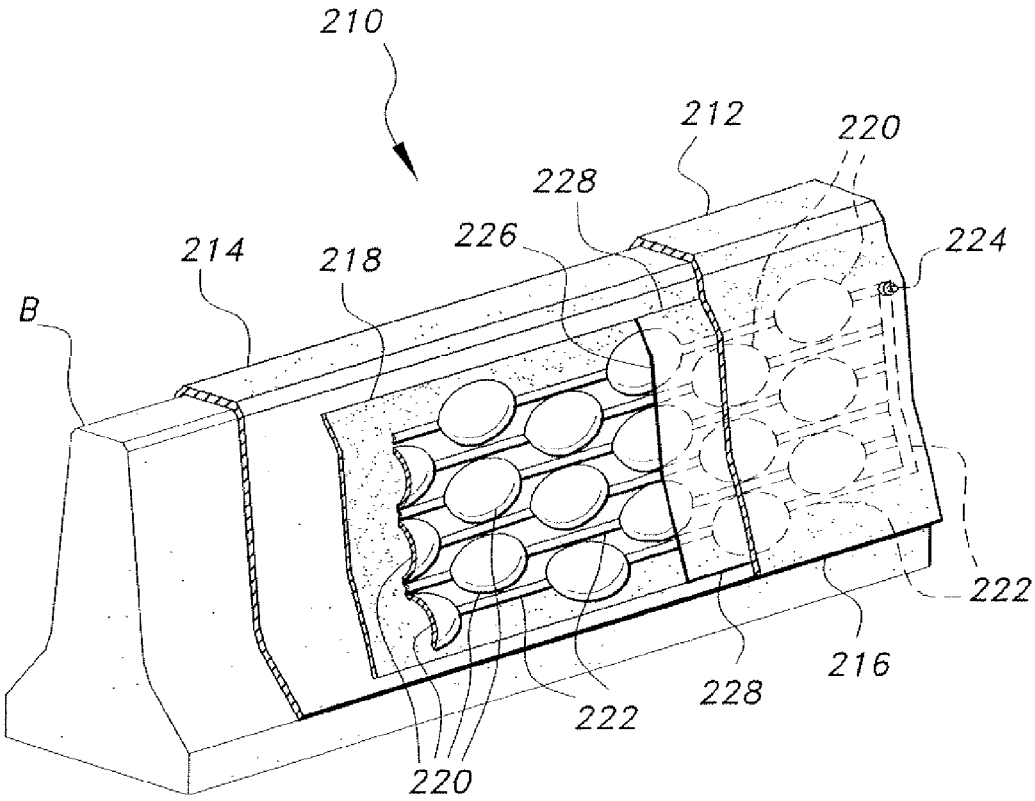
FIG. 2 is an environmental perspective view of a second embodiment of a cushioned cover for traffic structures according to the present invention, broken away and partially in section to show details thereof.

A large number of closely spaced, solid (i.e., not hollow) resilient elements 120 are disposed upon the inner layer 114 and extend outwardly therefrom, i.e., captured between the two layers 112 and 114. Alternatively, the resilient elements 120 may be attached to an intermediate sheet of resilient material, the intermediate sheet being captured between the outer and inner layers 112 and 114. Such a configuration is illustrated in FIG. 2 for an alternative resilient intermediate layer. The resilient elements 120 may each have generally hemispherical configurations, as shown, or may have some other configuration or combination of configurations. The resilient elements 120 are preferably formed of a somewhat softer and more resilient elastomer than the outer and inner layers 112 and 114, thus allowing the outer layer 112 to collapse more readily inwardly and to rebound more readily to its original shape when struck by a vehicle. The resilient elements 120 may be formed of a highly resilient polybutadiene elastomer, such as that used in the manufacture of Superball® toys, more generically known as "bouncy balls."

FIG. 2 of the drawings provides an environmental perspective view of an alternative embodiment of a cushioned cover 210 for traffic structures, the various layers of the cover 210 being progressively broken away to show the internal structure thereof. The cushioned cover or cover 210 is constructed somewhat like the cover 110 of FIG. 1 and discussed above, i.e., having an outer layer 212 and an inner layer 214 configured to fit closely over a concrete traffic barrier B or "Jersey wall" and having their mutual edges 216 bonded or otherwise secured together. The outer and inner layers 212 and 214 may be formed of the same materials as used for the manufacture of the two layers 112 and 114 of the first embodiment cushioned cover 210 discussed further above, i.e., natural or synthetic rubber, which may include recycled rubber from used tires and/or other sources. The outer layer 212 may include a tread pattern disposed thereon or therein, as in the case of the outer layer 112 of the embodiment 110 of FIG. 1. Such a tread pattern is optional, and is not shown in the embodiment of FIG. 2 for clarity in the drawing.

The cushioned cover for traffic structures 210 includes an intermediate or medial layer 218 disposed between the outer and inner layers 212 and 214, the medial layer 218 having a large number of generally hemispherical (or other shape), hollow, pneumatically inflated, resilient cells 220 disposed thereon. The inflatable cells 220 are pneumatically interconnected with one another by a pneumatic manifold 222, which, in turn, connects to an air valve 224 extending to the outside of the cover 210. Alternatively, each row of cells 220 may be provided with its own air valve to provide greater adjustability of the air pressure within the cover 210. The air valve 224 allows the cells 220 to be inflated to any practicable air pressure, depending upon the requirements of the cover 210 installation. An intermediate cover sheet or ply 226 may be provided over the medial layer 218 and its pneumatic cells 220 and manifold 222, the medial layer 218 and its cover sheet 226 being sealed or bonded together along their mutual edges 228. It will be noted that the edges 228 of the intermediate layer 218 and its cover sheet 226 are separate from the edges 216 of the outer and inner layers 212 and 214. This allows the medial layer 218 with its pneumatic cells 220 and cover sheet 226 (if installed) to be removed from between the outer and inner layers 212 and 214 for repair or replacement, as required.

Figure 3:
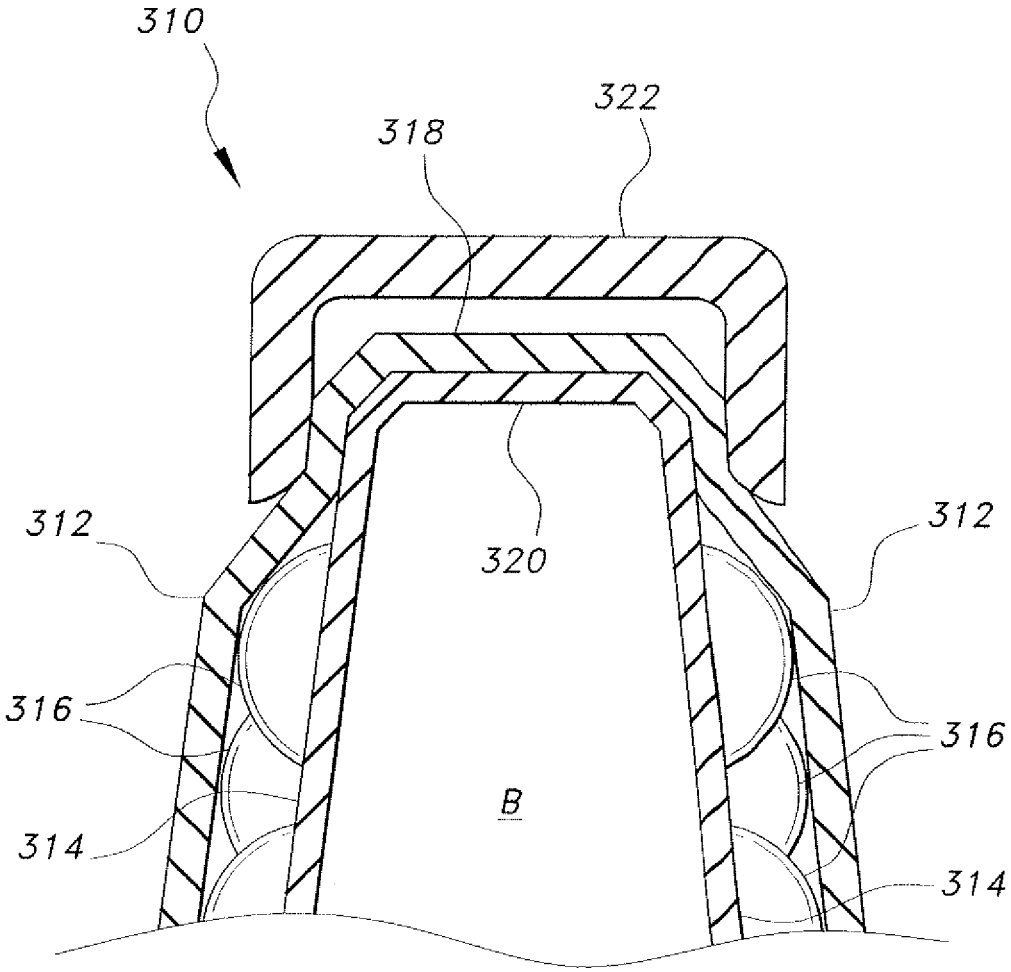
FIG. 3 is an end view in section of a cushioned cover for traffic structures according to the present invention, showing a first embodiment of a clamp for securing the cover to a concrete traffic barrier.
Figure 4:
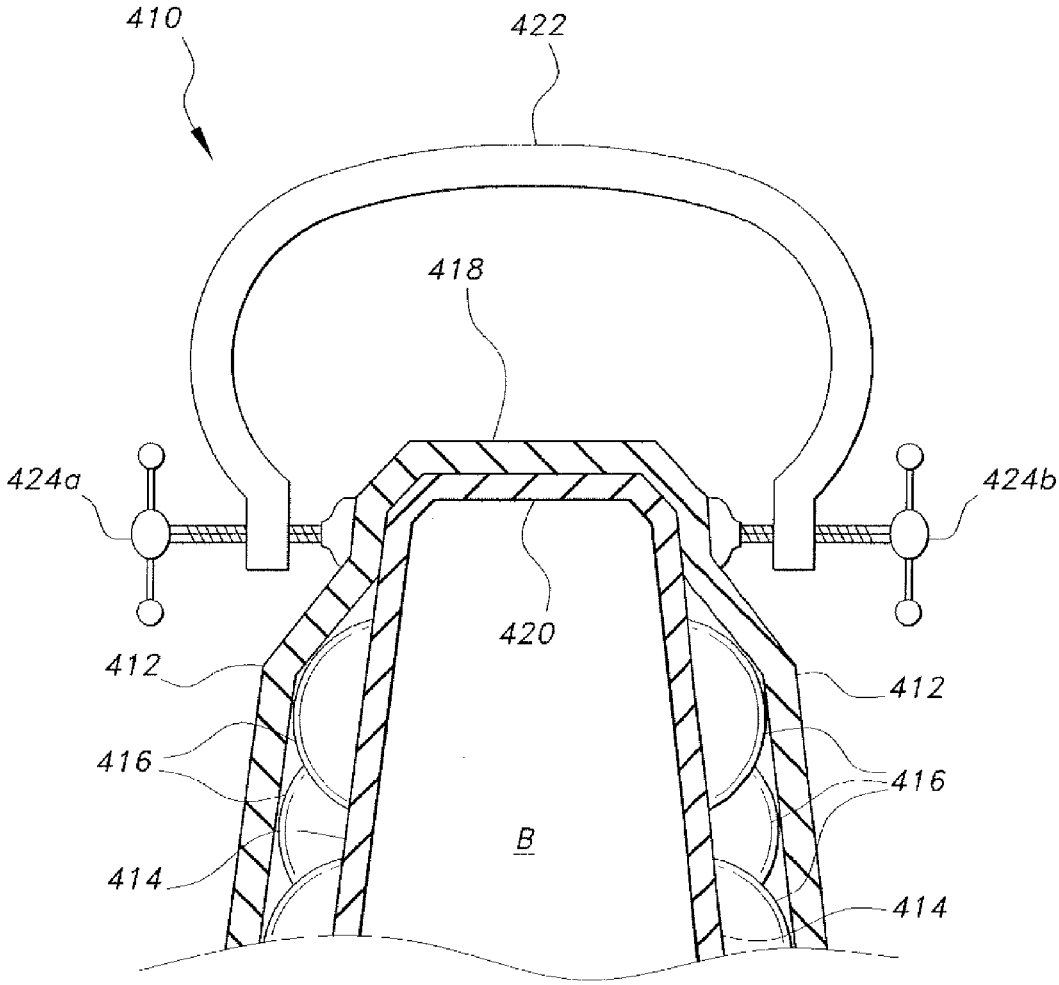
FIG. 4 is an end view in section of a cushioned cover for traffic structures according to the present invention, showing a second embodiment of a clamp for securing the cover to a concrete traffic barrier.

FIGS. 3 and 4 are end elevation views in section showing means of positively securing the cushioned covers to a concrete traffic barrier. In FIG. 3, the cushioned cover 310 includes an outer layer 312 and an inner layer 314 substantially identical to the corresponding components of the embodiments of FIGS. 1 and 2. The resilient intermediate elements 316 may comprise solid resilient components, as in the embodiment 110 of FIG. 1, or may comprise inflatable components, as in the embodiment 210 of FIG. 2. The cushioned cover for traffic structures 310 is configured to secure over a concrete traffic barrier B, substantially as in the cases of the first two embodiments 110 and 210 of FIGS. 1 and 2. This is accomplished by providing an upper panel 318 for the outer layer 312 and an upper panel 320 for the inner layer 314, the two upper panels 318, 320 being bonded or otherwise joined directly to one another, generally as shown in FIG. 3. The two upper panels 318 and 320 are configured to drape or otherwise be disposed across or over the upper part of the barrier B, as shown.

In the exemplary embodiment of FIG. 3, a clamp 322 of unitary, monolithic structure extends across the top of the barrier B and the upper panels 318 and 320 of the cushioned cover 310 to secure the cover 310 to the barrier B. The clamp 322 may be formed of a sturdy, slightly resilient plastic material, or as a thinner device formed of spring steel or other suitable material. The jaws of the clamp 322 may thus be spread slightly to grip the upper panels 318 and 320 of the cover 310 against the upper portion of the barrier B.

FIG. 4 illustrates a cushioned cover 410 having substantially the same configuration as the cover 310 of FIG. 3, shown installed over a concrete traffic barrier B. The cushioned cover 410 includes an outer layer 412 and an inner layer 414, substantially identical to the corresponding components of the embodiments of FIGS. 1 through 3. The resilient intermediate elements 416 may comprise solid resilient components as in the embodiment 110 of FIG. 1, or may comprise inflatable components, as in the embodiment 210 of FIG. 2. The cushioned cover for traffic structures 410 is configured to secure over a concrete traffic barrier B, substantially as in the cases of the first two embodiments 110, 210, and 310, respectively, of FIGS. 1 through 3. This is accomplished by providing an upper panel 418 for the outer layer 412 and an upper panel 420 for the inner layer 414, the two upper panels 418, 420 being bonded or otherwise joined directly to one another, generally as shown in FIG. 4. The two upper panels 418 and 420 are configured to drape or otherwise be disposed across or over the upper part of the barrier B, as shown.

In the exemplary embodiment of FIG. 4, a clamp 422 extends across the top of the barrier B and the upper panels 418 and 420 of the cushioned cover 410 to secure the cover 410 to the barrier B. The clamp 422 is generally in the form of a C-clamp or the like, but includes mutually opposed first and second threadably adjustable members 424*a* and 424*b*. Either or both members 424*a*, 424*b* may be adjusted to grip the upper panels 418 and 420 of the cover 410 against the upper portion of the barrier B. Alternatively, one of the two adjustable members 424*a* or 424*b* may be eliminated, and a single adjustable member may be provided to secure the clamp 422 across the upper portions of the cover 410 and the underlying barrier B.

Figure 5:
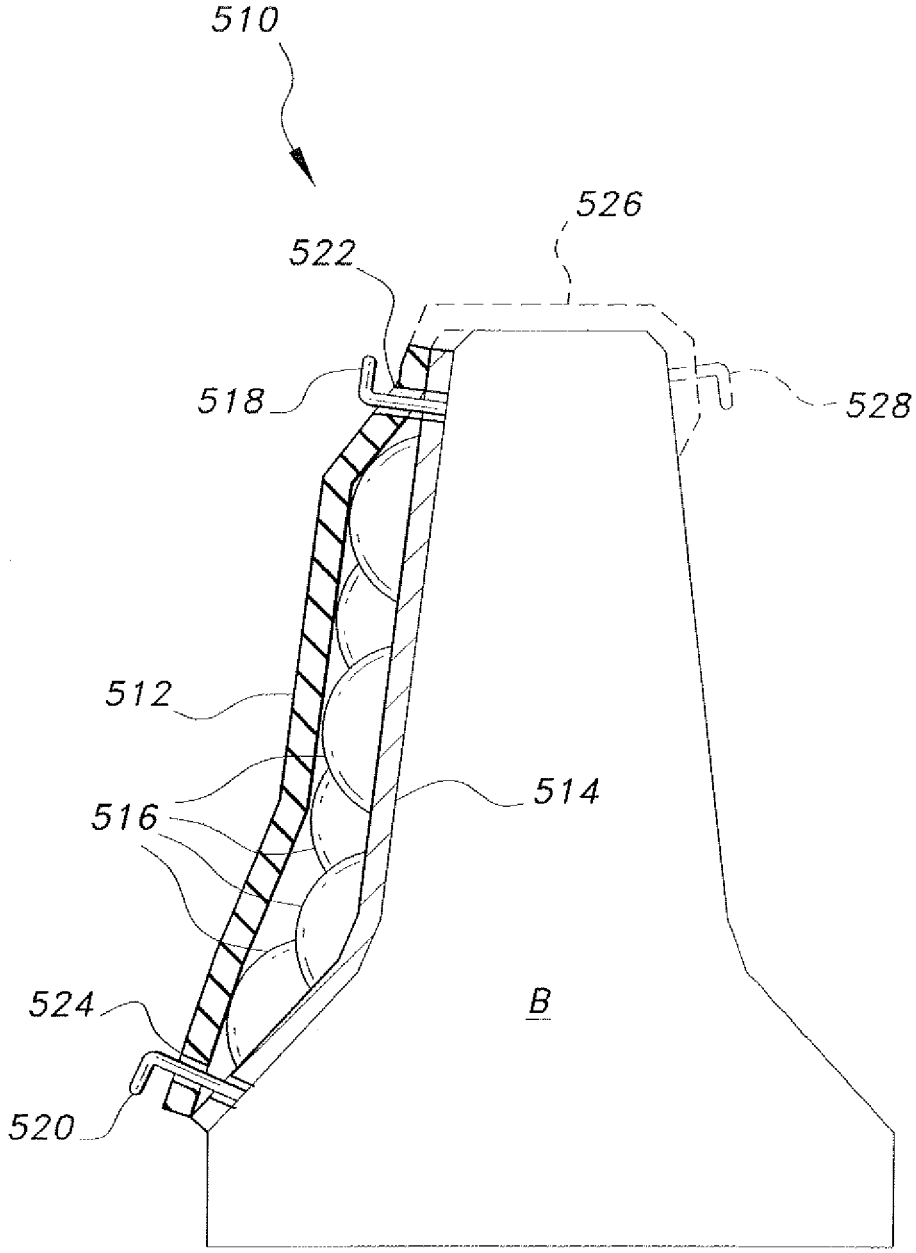
FIG. 5 is an end view in section of a cushioned cover for traffic structures according to the present invention, showing attachment of the cover to a single face of the concrete traffic barrier.

FIG. 5 provides an end elevation view in section of an alternative embodiment of a cushioned cover for traffic structures, designated as cover 510. In the example of FIG. 5, the cover 510 is configured to cover only one side of the barrier B. Such a configuration may be desirable where such concrete barriers B are placed along the outer edge of the traffic lane(s) to separate the traffic lane(s) from pedestrian traffic and/or other non-motor vehicle environment. In such a case it is not necessary to provide resilient coverage of the side or surface of the barrier B opposite the motor vehicle traffic, and thus the cover 510 may be manufactured more economically than a two-sided cover. In FIG. 5, the cover 510 has a single-sided outer layer 512 and a corresponding single-sided inner layer 514, and a plurality of intermediate resilient elements 516 (either solid or pneumatically inflated) captured therebetween. Upper and lower hooks 518 and 520 are installed in the concrete barrier B, the cover 510 having corresponding passages 522 and 524 therethrough for installing the cover removably over the hooks. The outer layer 512 may optionally include an upper panel 526 (shown in broken lines in FIG. 5) that passes over the top of the barrier B to secure to an opposite upper hook 528 extending from the opposite upper side of the barrier, as shown in broken lines.

Figure 6:
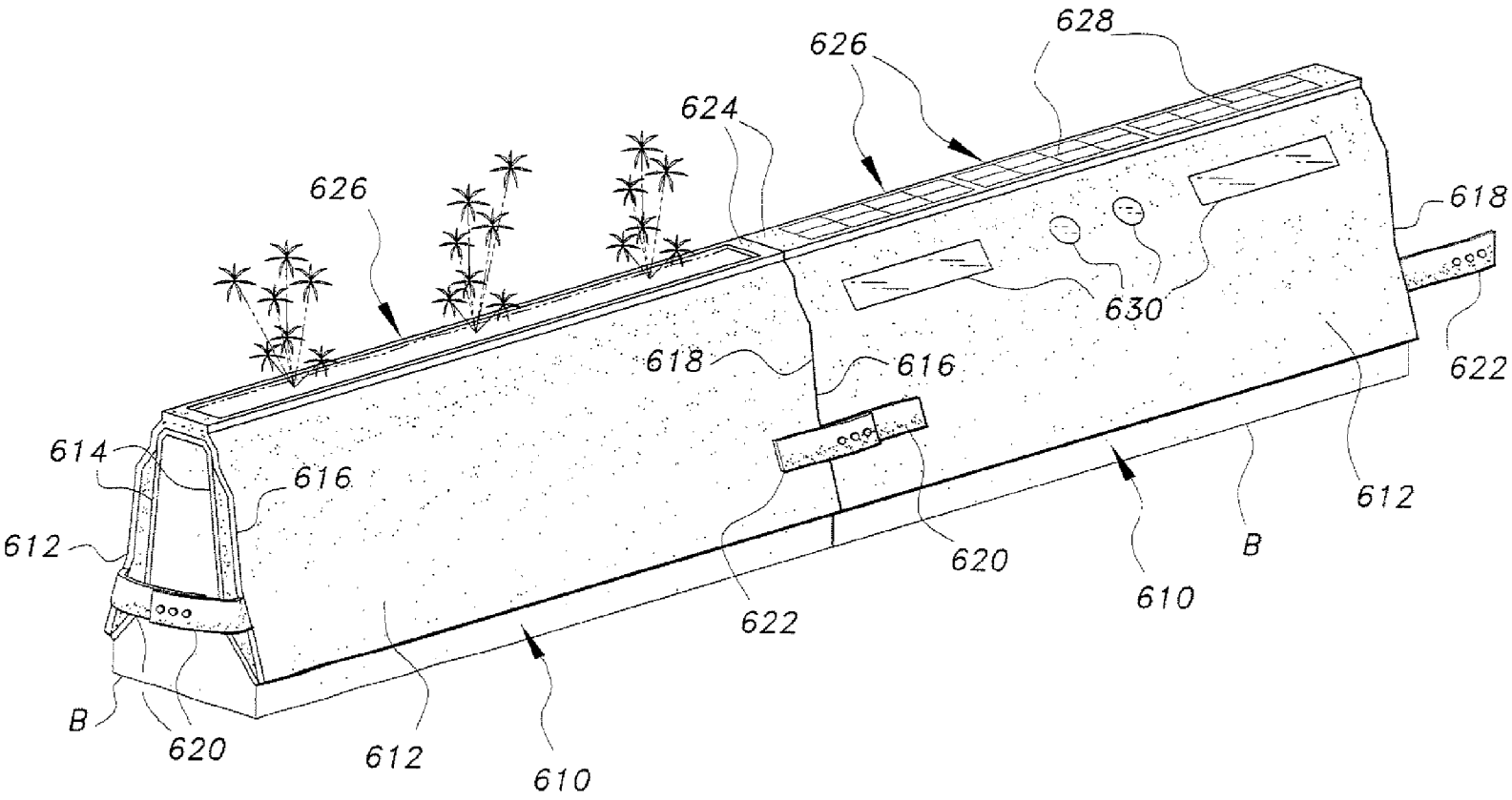
FIG. 6 is an environmental perspective view of an additional embodiment of a cushioned cover for traffic structures according to the present invention, having another securing and attachment system and additional alternatives.

FIG. 6 of the drawings is an environmental perspective view illustrating additional alternative features of the cushioned cover for traffic structures. In FIG. 6, two cushioned covers 610 are connected together end-to-end over an assembly of concrete barriers B. Each of the covers 610 includes an outer layer 612 and inner layer 614 (seen in edge view to the left end of the assembly in FIG. 6), and an intermediate layer of resilient elements (not shown in FIG. 6, but corresponding to such elements as illustrated in previous drawings). Each of the covers 610, or more specifically the outer layers 612 thereof, has a first end and an opposite second end 616 and 618. Mating connector straps 620 and 622 extend from the ends 616 and 618 of the outer layer 612 of each cover 610, one of the connector straps having a series of pins or posts extending therefrom and the opposite strap having mating holes or passages. (The various connector straps illustrated in FIG. 6 are shown only generally, and may be adjusted or configured for universal attachment around the end of a barrier B or to an adjacent cover.) The connector straps of adjacent ends of adjacent covers releasably connect to one another to connect the adjacent covers 610 to one another, generally as shown in FIG. 6. Alternative cover connection means may be provided, e.g., buckles, etc., if desired.

FIG. 6 also illustrates additional alternative features for the cushioned cover 610, it being understood that these additional features may optionally be incorporated in one or more of the previously discussed embodiments of FIGS. 1 through 5. The upper panel 624 generally includes at least two thicknesses or layers of material, and is thus relatively thick. Additional plies or layers of material may be provided in the upper panel 624, if desired. The resulting thickness is sufficient to allow one or more accessory receptacles 626 to be formed therein, e.g., for a planter box, as shown in the left side cover of FIG. 6, or for the installation of one or more solar cells 628 therein, as shown in the right side cover of FIG. 6. The solar cells 628 are connected conventionally to appropriate circuitry for charging a conventional electrical storage battery (not shown), the battery providing electrical power to one or more electric lights 630 disposed in the outer layer 612 of the cover 610. Such lights provide warning and illumination for traffic traveling at night or in dim conditions adjacent to such lighted covers.

Figure 7:
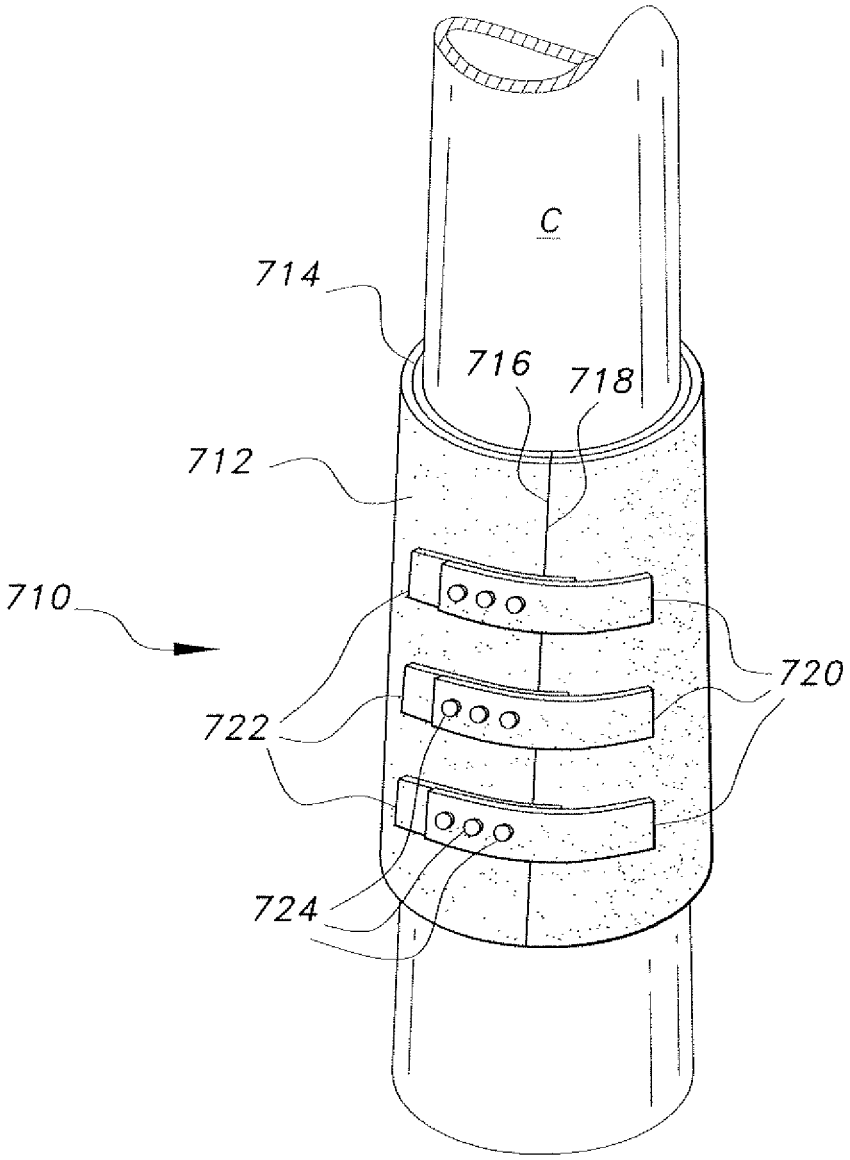
FIG. 7 is a partial perspective view of yet another embodiment of a cushioned cover for traffic structures according to the present invention, showing a wrap-around cover for removable installation upon a traffic pole, post, column, or stanchion.

FIG. 7 illustrates yet another embodiment of a cushioned cover for traffic structures, designated as cover 710. The basic structure of the cushioned cover 710 is generally similar to that of the other covers 110 through 610 described further above, incorporating an outer layer 712, an inner layer 714, and a plurality of intermediate resilient elements (not shown in FIG. 7, but substantially as shown and described for other embodiments). Rather than having an upper extension or panel that extends over the top of a structure, such as a traffic barrier, the cover 710 has a relatively flat configuration when spread on a planar surface. As in the case of other embodiments, the cover 710 includes mutually opposed first and second ends 716 and 718, and one or more first connector straps 720 extending from the first end 716 and corresponding second connector straps 722 extending from the outer layer 712 of the cover adjacent its second end 718. The first connector straps 720 may have a plurality of holes or passages (not shown) therein, with the second connector straps having a corresponding plurality of buttons or posts 724 extending therefrom. This allows the resilient cover 710 to be wrapped or secured about a traffic structure, such as a column C, to form a closed, generally cylindrical configuration, the two ends 716 and 718 abutting or overlapping one another and the straps 720 extending from the first end 716 being releasably secured to the pins or buttons 724 of the second straps 722 extending from the opposite second end 718.

It is to be understood that the present invention is not limited to the embodiments described above, but encompasses any and all embodiments within the scope of the following claims.

I claim:

1. In combination, a traffic structure and a cushioned cover for the traffic structure, comprising:

an elongated traffic structure, the traffic structure having a base for engaging a supporting surface, a pair of opposing side surfaces, a pair of opposing end surfaces defining the length of the structure, and an upper portion;

a cushioned cover for the traffic structure, the cushioned cover comprising:

a continuous, unbroken, resilient outer layer, the outer layer having an upper panel central region and mutually opposed outer edges;

a continuous, unbroken, resilient inner layer being substantially coextensive with the outer layer, the inner layer having an upper panel central region and mutually opposed outer edges connected to the opposed edges of the outer layer; and a medial layer disposed between the outer layer and the inner layer, the medial layer having a central region and mutually opposed outer edges and being substantially coextensive with both the inner and outer layers, the medial layer having a plurality of closely spaced, solid, resilient elements disposed upon the inner layer and sandwiched between the inner layer and the outer layer and extending from the opposed outer edges to a location adjacent the central region thereby leaving an unobstructed central region that overlies the upper portion of a traffic structure, wherein the central region consists of the central regions of the upper panels of each of the outer and inner layers being joined to each other and only the unobstructed central region contacts the upper portion of the traffic structure.

2. The combination according to claim 1, further comprising at least one clamp, the clamp being adapted to selectively and removably grip the unobstructed central regions that overlie an upper portion of the traffic structure.

3. The combination according to claim 1, wherein the clamp is made from a unitary, monolithic resilient plastic material.

4. The combination according to claim 3, wherein the clamp is a C-clamp.

5. The combination according to claim 1, further comprising:

at least one solar panel disposed atop the unobstructed central regions that overlie the upper portion of the traffic structure; and at least one light disposed upon the unobstructed central regions that overlie the upper portion of the traffic structure outer, the light communicating electrically with the solar panel.

6. The combination according to claim 1, further comprising a tread pattern disposed upon the outer layer.

7. The cushioned cover for traffic structures according to claim 1, wherein the outer layer has mutually opposed first and second ends, the cushioned cover further comprising:

at least one first connecting strap extending from the first end of the outer layer; and at least one second connecting strap extending from the second end of the outer layer, the first connecting strap and the second connecting strap selectively and releasably connecting to one another.

8. The combination according to claim 1, wherein the solid, resilient elements define hemispherical configurations.

9. The combination according to claim 1, wherein the solid, resilient elements are formed from polybutadiene.

* * * * *